United States Patent [19]

Rumsey

[11] Patent Number: 4,809,335

[45] Date of Patent: Feb. 28, 1989

[54] SPEECH UNIT FOR DOLLS AND OTHER TOYS

[76] Inventor: Daniel S. Rumsey, 5520 W. 118th Pl., Inglewood, Calif. 90304

[21] Appl. No.: 790,949

[22] Filed: Oct. 24, 1985

[51] Int. Cl.[4] ..... G10L 9/10

[52] U.S. Cl. ..... 381/53; 446/175; 446/297; 446/397; 364/513.5; 200/61.45 R

[58] Field of Search ..... 446/175, 297, 303, 397, 446/480; 381/51, 52, 53; 364/513.5; 200/65.45 R

[56] References Cited

U.S. PATENT DOCUMENTS 4,696,653 9/1987 McKeefery ..... 446/175

*Primary Examiner*—Peter S. Wong
*Assistant Examiner*—Anita M. Ault
*Attorney, Agent, or Firm*—Blakely, Sokoloff, Taylor & Zafman

[57] ABSTRACT

A speech unit for producing preselected words or phrases based on the orientation of a toy doll or figure. A gravity sensing means produces an output corresponding to the orientation of the sensing means with respect to gravity. The output of the sensing means is coupled to a speech synthesizer which produces an output based on transitions from one orientation of the sensing means to a second orientation. A timing circuit coupled to the sensing means establishes a time period during which the sensing means must maintain its orientation for an output to be realized. The timing means also is used to shut off power to the speech synthesizer and speaker means to conserve power of the circuit. In an alternate embodiment, the absolute position of the sensing means is used to select a speech output.

43 Claims, 4 Drawing Sheets

SPEECH UNIT FOR DOLLS AND OTHER TOYS

BACKGROUND OF THE INVENTION

1. Field of the Invention

This invention relates to the field of sound producing apparatus for dolls and other toys and particularly to a system for electronically producing spoken words or phrases in response to changes in the orientation of a doll or other toy.

2. Prior Art

In an effort to produce a toy doll or figure which will appear more lifelike to a user such as a child, the prior art has utilized various systems for producing speech or other sounds from the figures. Typical of these are mechanical sound producing devices which produce sounds in response to compression or other movement of the figure by the child or means for selecting randomly selected pre-recorded messages in response to activation by the user.

More recently, dolls have been designed which provide vocal responses dependent upon the movement of particular appendages, (Tepper et al., U.S. Pat. No. 3,755,960) and dolls which have articulated face movements and automatic movement of arms and legs in conjunction with prerecorded speeches (Noll, U.S. Pat. No. 3,685,200).

With the advent of relatively low priced integrated circuits, dolls having a digitally synthesized voice has been produced. One such doll is disclosed in Stowell et al., U.S. Pat. No. 4,318,245 (1982). The doll of Stowell includes a digital controller which stores a plurality of sounds. The digital controller is coupled to a speech synthesizer and the various sounds are produced through a speaker in response to signals produced by a motion detector which changes in response to movement of the doll. The doll of Stowell produces sounds which are generated by frequency of motion of the doll. The sounds produced do not relate directly to the position of the doll but rather to the movement the doll is undergoing. This has the disadvantage of requiring the child to constantly move the doll in order to produce a sound. Additionally, the sounds produced by the doll are not easily reproducible in the doll by the user, the sounds being independent of doll position and being related to frequency of motion.

Therefore, it is the principal object of the present invention to provide a talking doll or toy which produces spoken words or phrases based on the orientation of the doll.

It is a further object or the present invention to provide a talking doll or toy in which the movement from one orientation to a second orientation produces a spoken word or phrase.

Yet another object of the present invention is to provide a talking doll or toy which will reduce the power consumed when the doll or toy is stationary for a certain period of time.

SUMMARY OF THE PRESENT INVENTION

The present invention provides a doll which has a gravity sensing switch means disposed within the doll. The switch means provides a plurality of outputs depending upon the orientation of the doll with respect to gravity. A converting means coupled to the switch means converts the position indicating signals to a plurality of digital words. The digital words are coupled to a speech synthesizer which produces one of a number of stored words or phrases in response to the digital word. A loud speaker disposed within the doll and coupled to the speech synthesizer allows the chosen words or phrases to be heard by the user.

The present invention contemplates a doll which will produce a sound each time the doll is at a certain orientation. However, the present invention also allows for the production of sound when the doll is moved from one of a plurality of positions to a second position.

BRIEF DESCRIPTION OF THE DRAWINGS

FIG. 4*b* illustrates a cover for the toy ball of FIG. 4*a*.

DETAILED DESCRIPTION OF THE PRESENT INVENTION

Figure 1:
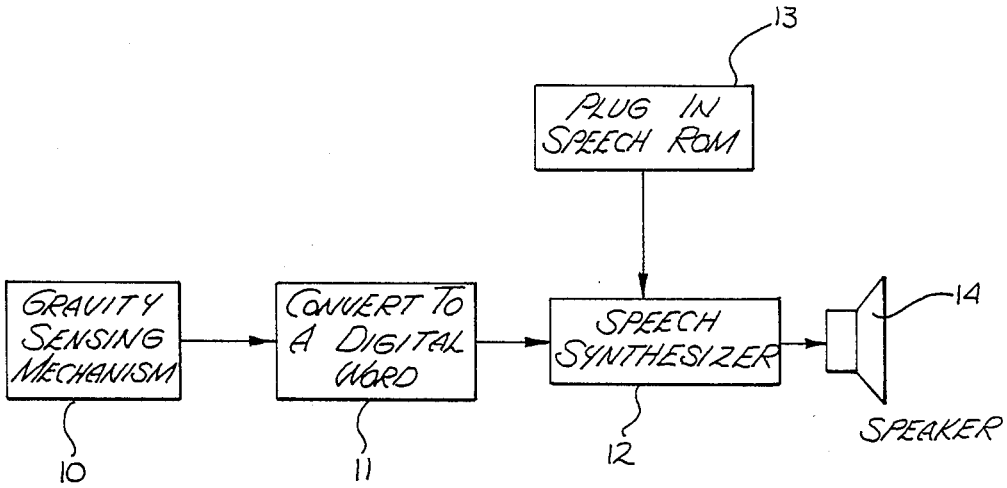
FIG. 1 is a block diagram illustrating the speech unit of the present invention.

The layout of the preferred embodiment of the present invention is illustrated in FIG. 1. A gravity sensing mechanism 10 is disposed within a doll or other figure and provides a variety of outputs, each output dependent upon the orientation of the mechanism with respect to gravity. This gravity switch 10 is coupled to converting means 11 which converts the orientation signal into a digital word having a certain number of bits (in the preferred embodiment 3 bits) and is also used to determine when an orientation change has occurred. This converting means 11 is then coupled to the speech synthesizer 12. The speech synthesizer 12 selects a word or phrase from the plug-in speech memory 13 for each orientation of the gravity switch 10. The present invention can also be designed so that the speech synthesizer selects a word or phrase in response to changes in orientation from one position to a second position. In other words, if there are 8 detectable orientations of the gravity switch, the speech synthesizer 12 can be utilized to output a word or phrase whenever the switch is in one of the 8 orientations. In addition, the speech synthesizer 12 can be utilized to select a word or phrase for each change in orientation from one switch position to a second switch position. For example, a change from switch position 1 to switch position 7 would represent a certain phrase or word while a change in orientation from switch position 3 to switch 5 would represent another word or phrase. In this manner, 64 different words or phrases can be repeatably produced by movement of the doll by a user instead of the 8 made in response only to the orientation of the doll. The plug-in speech memory 13 in the preferred embodiment is a read only memory (ROM) which may be easily replaced so that a large variety of responses are available. The speech synthesizer 12 is coupled to a speaker 14 and with appropriate amplification means audible sounds are produced from the doll.

Figure 2:
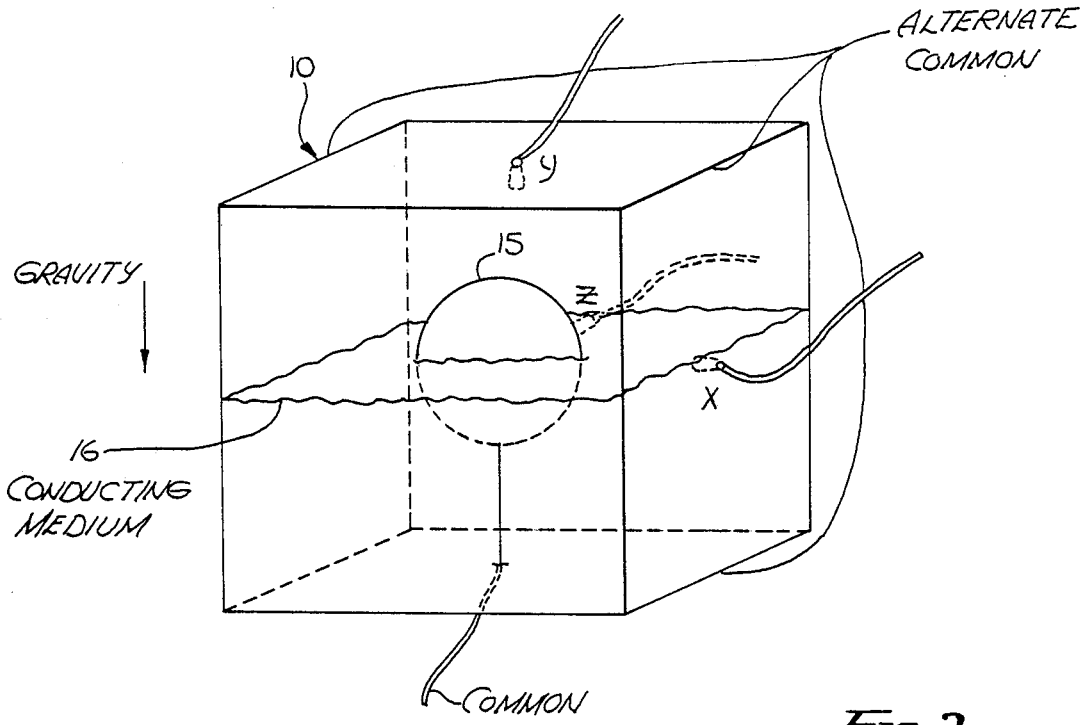
FIG. 2 is a perspective view of the gravity sensing means of the present invention.

The gravity switch 10 is shown in greater detail in FIG. 2. In the preferred embodiment, the gravity sensing means 10 comprises a cube partially filled with a conducting medium 16. Electrical contacts are placed on orthogonal faces of the cube such as electrodes X, Y and Z. A common electrode 15 is disposed in the approximate center of the cube so that it will contact the conducting medium for all orientations of the cube. However, a plurality of common electrodes may be disposed about the cube so that if an electrode is contacted by the conducting medium, the common will be contacted as well. Referring to FIG. 2 alternate common contacts are shown disposed on cube edges adjoining the faces on which contacts X, Y and Z are located. Whenever the conducting medium contacts one of the electrodes X, Y or Z, a conducting path is formed between that electrode and the common electrode. Whenever the medium does not touch an electrode, there is no conducting path and an open circuit results. Thus, each of these contacts acts as an on-off switch. In FIG. 2, the medium 16 is shown touching electrodes X and Z while electrode Y is isolated. If electrodes X, Y and Z were considered a series of bits such a configuration could be represented digitially by 101, where 1 represents a closed switch. In the preferred embodiment, the conducting medium is a slightly saline water solution, although other suitable conducting mediums such as mercury, may be employed. In addition, an inert conducting powder can be utilized as a conducting medium. For example, activated carbon will function, as well as stainless steel particles. An example of activated carbon is produced by Fisher Scientific. The material is a 6–12 mesh and is further ground to reduce the particle size. An inert material for the electrodes, such as stainless steel, is recommended to avoid oxidation which might prevent an electrical contact between the electrodes and the conducting medium. Other mediums which may be utilized include sulfides, oxides and nitrides formed from the group IV, V and VI elements of the periodic table, carbon derived isomorphs, graphite, powdered metal of all types, as well as nonstoichiometric compounds of the transition metals of groups VIII A, III and IV of the periodic table.

Although shown as a cube, any suitable volume may be employed as the container for the conducting medium so long as electrodes such as X, Y and Z are spaced on the surface of the volume in a manner which will allow a plurality of distinct orientations to be defined.

Continuing the convention that a closed connection between an electrode X, Y or Z and the common electrode 15 equals a "1", the following table illustrates 8 possible orientations of the gravity sensing means 10 which may be defined.

| Orientation Position | X Contact | Y Contact | Y Contact |
|---|---|---|---|
| 1 | 0 | 0 | 0 |
| 2 | 0 | 0 | 1 |
| 3 | 0 | 1 | 0 |
| 4 | 0 | 1 | 1 |
| 5 | 1 | 0 | 0 |
| 6 | 1 | 0 | 1 |
| 7 | 1 | 1 | 0 |
| 8 | 1 | 1 | 1 |

Although 8 detectable orientations are illustrated in the preferred embodiment, any number of detectable orientations may be had by utilizing an appropriate number of electrodes. For example, a fourth electrode would result in 12 detectable orientations.

Figure 3A:
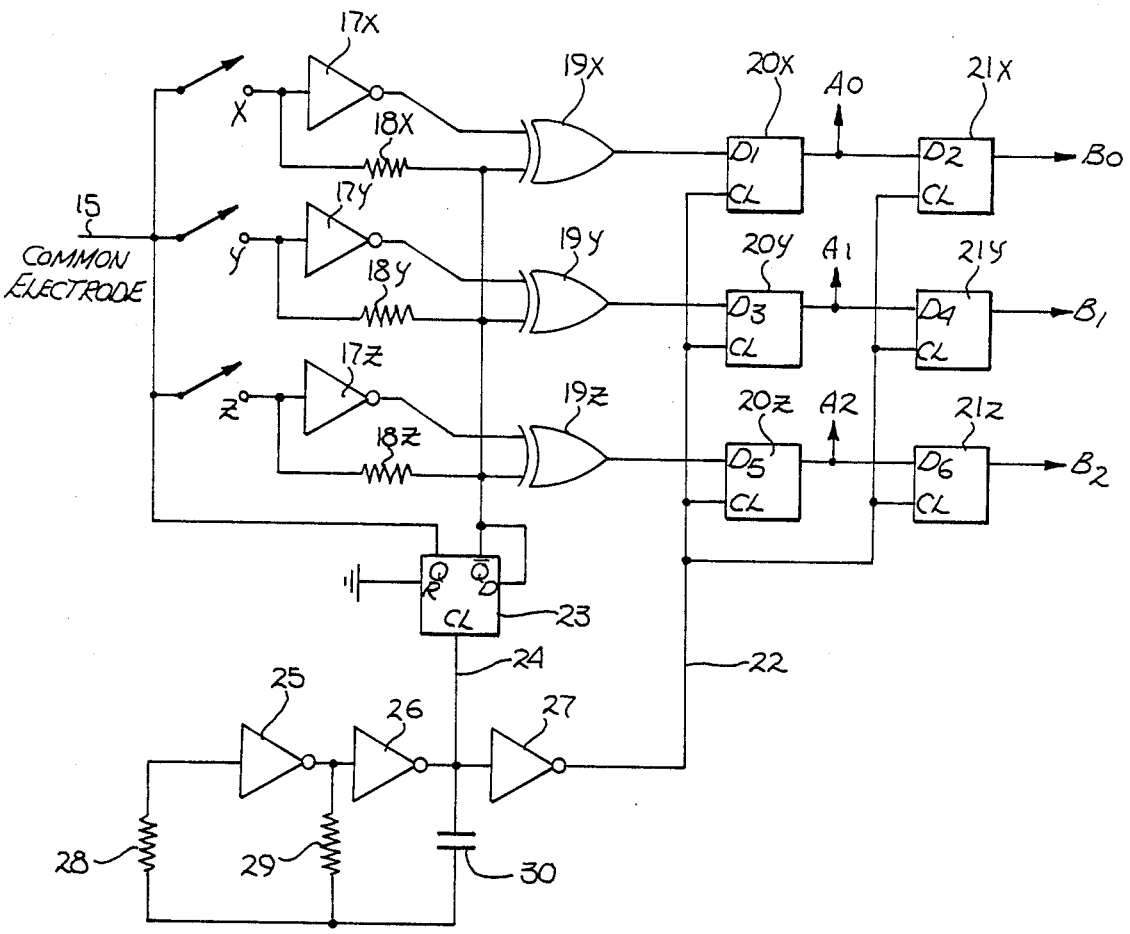
FIGS. 3*a* and 3*b* are circuit diagrams illustrating the speech unit of the present invention.

When a saline solution is used as the conducting medium in the gravity switch, there exists the possibility of electroplating of the electrodes which would eventually render the switch inoperative. In order to prevent such a problem, the present invention contemplates circuitry coupled to the switch for reversing the polarity of the electrodes X, Y and Z and the common electrode 15. This circuitry is shown in FIG. 3*a*. Gravity switch 10 is represented by switches X, Y and Z. The output of each electrode X, Y and Z is coupled through a Schmidt trigger inverter to one input of an exclusive OR gate and through a resistor to the other input of the exclusive OR gate. For example, contact X is coupled through Schmidt trigger inverter 17X to exclusive OR gate 19X and through resistor 18X to exclusive OR gate 19X. Contact y is coupled through Schmidt trigger inverter 17Y and resistor 18Y to exclusive OR gate 19Y while contact Z is coupled through Schmidt trigger inverter 17Z and resistor 18Z to exclusive OR gate 19Z. Coupled between each resistor and its appropriate exclusive OR gate is the complementary output of flip flop 23. The true output of flip flop 23 is coupled to the common electrode 15. This flip flop 23 is clocked through an oscillator comprised of inverters 25, 26, 27, resistors 28 and 29 and capacitor 30. The output of inverter 25 is coupled through resistor 29 and resistor 28 to the input of inverter 25. It is also coupled through resistor 29 and capacitor 30 to the output line of inverter 26. The output of inverter 25 is coupled to the input of inverter 26 while the output of inverter 26 is coupled to the input of inverter 27. The output of inverter 26 is coupled on line 24 to the clock input of flip flop 23.

Referring to the X contact, when the $\overline{Q}$ output of flip flop 23 is high and the Q output is low, both inputs to exclusive OR gate 19X will be high when the switch is opened, producing a low output from exclusive OR 19X. When the switch is closed, the Schmidt trigger 17X turns off, creating an imbalanced input to the exclusive OR gate 19X and resulting in a high output from that gate. When the oscillator reverses the output of flip flop 23 so that $\overline{Q}$ is low and Q is high, both inputs to exclusive OR gate 19X will be low when the switch is open, producing a low output from the gate. When the switch closes, the Schmidt trigger will be turned on and the output from exclusive OR gate 19X will be high. Thus, regardless of the polarity of the electrodes, the exclusive OR gates 19X through Z produce a low output when the switch is open and a high output when the switch is closed.

The outputs of the exclusive OR gates 19X through 19Z are coupled to flip flops 20X through 20Z respectively. These flip flops store the current orientation state of the gravity sensing means. The output of these flip flops 20X, 20Y and 20Z is A0, A1, and A2 respectively. The output of these flip flops is also coupled to the inputs of flip flops 21X through 21Z. These flip flops store the prior orientation of the gravity switch and the output of these flip flops is B0, B1 and B2 respectively. Both sets of flip flops are clocked from the output of inverter 27 of the oscillator circuit.

Figure 3B:
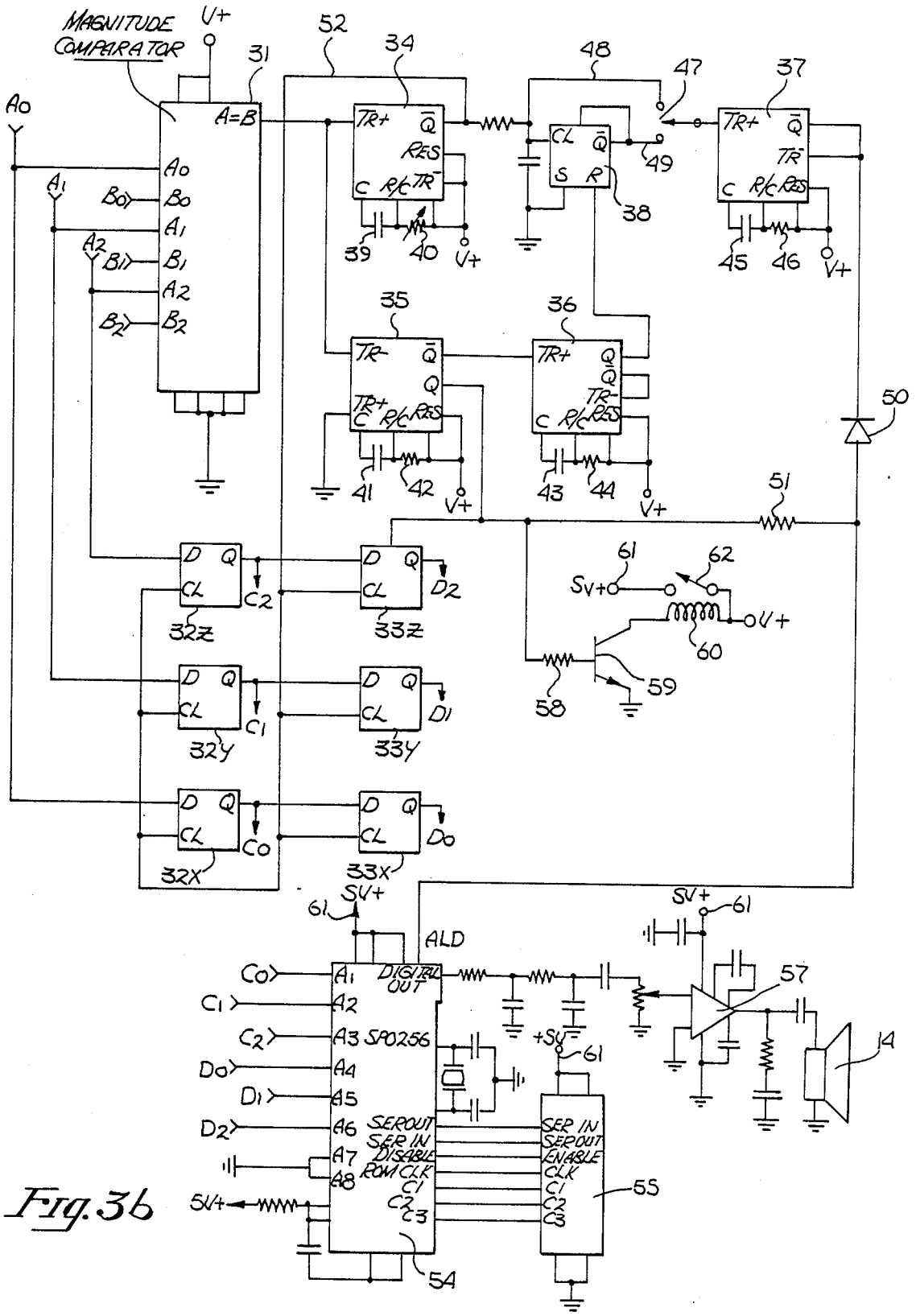

The timing circuit of the present invention is illustrated in FIG. 3*b*. The immediate position outputs (A0, A1 and A2) along with the delayed position outputs (B0, B1 and B2) are coupled to magnitude comparator 31. This comparator is an A=B comparator which has a high output when all the A inputs are equal to all the B inputs. Thus, if the immediate position signal is equal to the delay position signal, this indicates that the doll has not changed position for an amount of time at least equal to the oscillator period. When the inputs are different, (indicating a change in orientation) the output of the magnitude comparator 31 is low. The immediate position signals are also coupled to flip flops 32X through 32Z respectively. The output of these flip flops are coupled to flip flops 33X through 33Z respectively. The outputs of flip flops 33X through 33Z represent the "from" orientation while the outputs of flip flops 32X through 32Z represent the "to" orientation of the gravity switch. In the preferred embodiment of the present invention, speech output is based on the movement of the doll from one position to a second position, because there are 8 possible switch positions, there are 64 possible "from-to" transitions.

In order to enable a user to select "from-to" transitions it is desired that the switch positions be held for a certain period of time so that the phrases will be easily selectable by the user. To that end, a plurality of one shot multivibrators has been coupled to the magnitude comparator and are used to establish minimum and maximum time periods for switch position.

The output of comparator 31 is coupled to the trigger of one shot multivibrator 34. One shot 34 produces an output pulse on line 52 on the rising edge of an input pulse. Thus, when the A=B output of the comparator 31 goes low and then high (indicating a transition in orientation of the gravity switch) an output pulse is produced. The length of the pulse is controlled by capacitor 39 and potentiometer 40 coupled to the RC inputs of one shot 34. In the preferred embodiment of the present invention, the potentiometer allows this pulse to vary from 0 to 1 second. This output pulse is coupled on line 52 to the clocking inputs of flip flops 32X through 32Z and the clocking inputs of flip flops of 33X through 33Z. Thus, flip flops 32X through 32Z will not receive the immediate position signal from flip flops 20X thrugh 20Z unless the orientation of the gravity switch is constant for at least the time of the output pulse of one shot 34. This prevents the sensing of positions the gravity switch goes through in its transition from a "from" to a "to" position.

The output of magnitude comparator 31 is also coupled to the negative trigger of one-shot multivibrator 35. This is a "extended pulse" hook-up such that one shot 35 will have an output pulse as long as orientation changes are occurring plus for a time period determined by capacitor 41 and resistor 42 after switch changes have ceased. In the preferred embodiment of the present invention, capacitor 41 and resistor 42 are chosen so that one shot 35 produces an output pulse for 10 seconds after the changes have stopped occurring. Because the speech synthesizer and speaker consume the majority of the power in the speech unit, one shot 35 is used to turn off power to this portion of the circuit if changes have not occurred in the previous 10 seconds. The output of one-shot 35 is coupled through resistor 58 to the base of transistor 59. The collector of transistor 59 is grounded and the emitter is coupled to relay 60. When one shot 35 produces an output pulse, relay 60 is activated pulling switch 62 into contact with switch voltage node 61 and coupling voltage V+ to node 61. Speech synthesizer 54, speech ROM 55 and audio amplifier 57 are each coupled to switch voltage node 61. Thus, an output pulse from one shot 35 provides power to the speech synthesizer, speech ROM and amplifier of the speech portion of the circuit. When one shot 35 kicks off, switch 62 is opened and power is cut off from that portion of the circuit. The output of one shot 35 is also coupled through resistor 51 to the ALD input of speech synthesizer 54. This insures that the ALD input to the speech synthesizer is low during power down sequences.

Finally, the output of one shot 35 is coupled to the reset of flip flops 32X through 32Z and flip flops 33X through 33Z so that the inputs to speech synthesizer 54 are low when power is off.

The complementary output of one shot 35 is coupled to the positive trigger of one shot multivibrator 36. The output of one shot 36 is coupled to the reset of flip flop 38 and resets that flip flop during power down. The input of flip flop 38 is coupled to the output of one shot 34. The output of flip flop 38 is coupled on line 49 to one terminal on a two position switch 47. The output of one shot 34 is coupled on line 48 to the other terminal of switch 47. Switch 47 is a user selectable switch which, when coupled to line 48 results in speech output each time the gravity orientation changes from one "fixed" position to another "fixed" position. This somewhat limits the ability of the user to select specific words or phrases in a desired order since the start position of the next phrase is established by the stop position of the previous phrase. By connecting switch 47 to line 49, speech only occurs every other time the orientation changes. This permits a user to independently determine both the start and stop positions for the purposes of generating speech. The output of switch 47 is coupled to one shot multivibrator 37. The output of one shot 37 is coupled through reverse bias diode 50 to the ALD input of speech synthesizer 54. The output of one shot 37 signals the speech synthesizer 54 to commence speech.

Speech synthesizer 54 may be one of a variety of commercially available speech processors such as General Dynamics SPO256A, National Semiconductor MM54104, Texas Instrument TMS5220, Votrex SC-01, Mitsubishi M50800-SP, Signetics MEA-8000, etc. The speech processor 54 has 2 sets of inputs, the "from" inputs D0 through D2 from flip flops 33X through 33Z and the "to" inputs C0 through C2 from flip flops 32X through 32Z. Speech processor 54 is coupled to plug in speech ROM 55. Speech ROM 55 stores a word or phrase for each combination of inputs to speech processor 54. A sample listing of "from" "to" combinations and speech outputs contemplated in the preferred embodiment of the present invention is illustrated below:

| | FROM Signals | TO Signals | Speech Sequence |
|---|---|---|---|
| (1) | 000 (lying on back) | 001 (sitting up) | "I'm up" |
| (2) | 001 (sitting up) | 002 (lying on stomach) | "My tummy hurts" |
| (3) | 001 (sitting up) | 000 (lying on back) | "Milk" |
| | . | . | . |
| | . | . | . |
| | . | . | . |
| (64) | 111 (leaning to left) | 000 (lying on back) | "I'm sleepy" |

The output from the speech synthesizer 54 is coupled to an audio amplifier 57 through several RC filters. The amplifier 57 is coupled to voltage source 61 through switch 62 as described above. The output of amplifier 57 is coupled to audio speaker 14 where an audible word or phrase is produced.

An alternate embodiment of the present invention is contemplated where the absolute orientation of the gravity switch determines speech output as opposed to an orientation transition. In such a case only the immediate position signals would be provided to the speech synthesizer 54, resulting in only 8 combinations of words or phrases. In such an embodiment, the magnitude comparator would be utilized to determine if a change has taken place and its output would trigger a multivibrator such as multivibrator 34 so that an output would only be produced if the gravity switch maintains its new orientation for a fixed period of time. The timing circuitry which shuts off power to the speech synthesizer and audio amplifier can be maintained in such an embodiment.

Figure 4A:
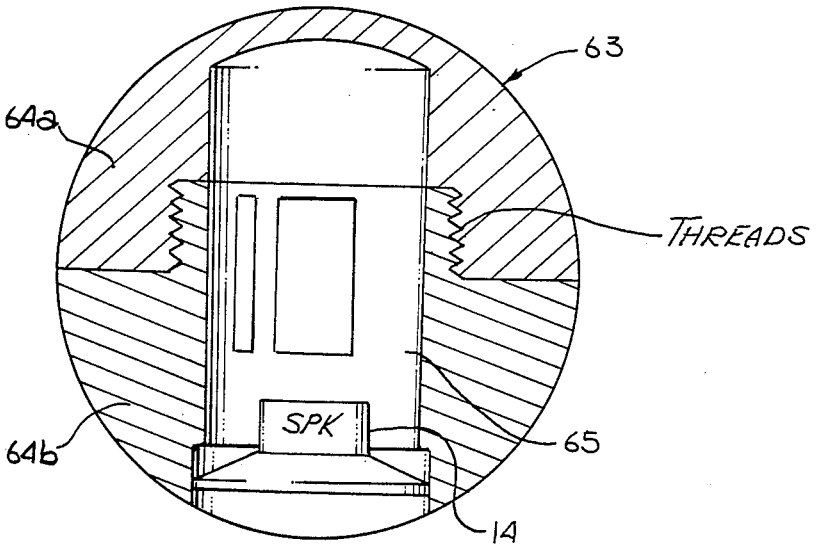
FIGS. 4*a* and 4*b* illustrate the present invention mounted within a toy ball.
Figure 4B:
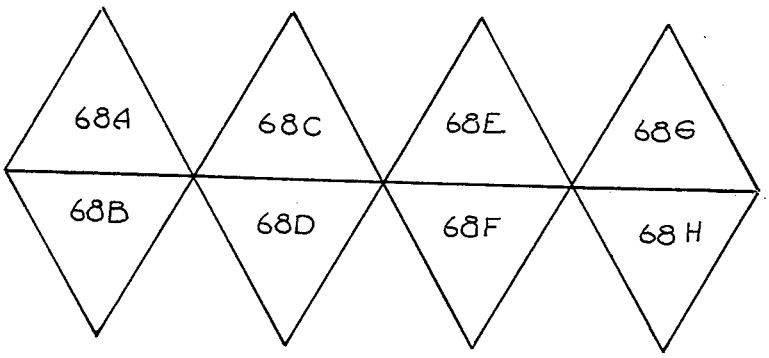

Although the present invention has been described in conjunction with its use in a doll, it may be employed with other toys as well. For example, it may be mounted inside the toy ball 63 of FIG. 4*a*. The ball consists of hollow halves 64A and 64B which may be threadedly engaged to form a sphere. In order to facilitate the play of a child user in producing repeatable words and phrases, the surface of the ball may be marked to indicate orientation. In the example shown in FIG. 4*b*, a covering 67 having 8 regions 68A–68H may be mounted on the surface of sphere 63. By orienting the ball 63 so that one of the regions faces upward, a user may repeatably produce words or phrases, whether their output depends on absolute ball orientation, or on a "from/to" scheme.

The speaker 14 is mounted within the ball 63 while the remainder of the speech unit is mounted on a board 65 within the ball. The board 65 may be eccentrically weighted to counter balance the weight of the speaker 14.

Thus, a speech unit has been described which, when used in conjunction with a toy figure or doll, produces words or phrases as a result of a change in orientation of the doll or figure by a user such as a child.

I claim:

1. A speech unit for use with a toy figure, said speech unit comprising:

a gravity sensing means for providing a plurality of first signals, said first signals corresponding to the orientation of said gravity sensing means with respect to gravity;

a converting means coupled to said gravity sensing means, said converting means for converting said first signals to a plurality of speech signals, each of said speech signals corresponding to one of said first signals;

speaker means coupled to said converting means, said speaker means for producing audible sounds in response to said speech signals.

2. The speech unit as claimed in claim 1 wherein said gravity sensing means comprises a hollow member partially filled with a conducting medium, a plurality of electrodes disposed on said member such that different combinations of said electrodes will contact said medium when said hollow member is at different positions with respect to gravity.

3. The speech unit as claimed in claim 2 wherein said hollow member comprises a cube.

4. The speech unit as claimed in claim 3 wherein at least one of said plurality of electrodes comprises a common contact.

5. The speech unit as claimed in claim 4 wherein said plurality of electrodes include at least three contacts disposed on orthogonal faces of said cube.

6. The speech unit as claimed in claim 5 wherein said common contact extends to the approximate center of said cube.

7. The speech unit as claimed in claim 6 wherein said medium comprises salt water.

8. The speech unit as claimed in claim 6 wherein said medium comprises mercury.

9. The speech unit as claimed in claim 1 wherein said converting means comprises a digital speech synthesizer coupled to a storage means, said storage means storing a plurality of pre-selected speech signals.

10. The speech unit as claimed in claim 1 wherein said toy figure comprises a doll.

11. The speech unit as claimed in claim 1 wherein said toy figure comprises a ball.

12. A speech unit for use with a toy figure, said speech unit comprising:

a gravity sensing means for providing a plurality of first signals, said first signals having a first and second state, said first signals corresponding to the orientation of said gravity sensing means with respect to gravity;

first converting means coupled to said gravity sensing means, said first converting means for concerting each change in the orientation of said gravity sensing means to one of a plurality of digital words;

second converting means coupled to said first converting means, said second converting means for converting said digital words to a plurality of speech signals;

speaker means coupled to said second converting means, said speaker means for producing audible sounds in response to said speech signals.

13. The speech unit as claimed in claim 12 wherein said gravity sensing means comprises a hollow member partially filled with a conducting medium, said member having a plurality of electrodes disposed on the surface of said member.

14. The speech unit as claimed in claim 13 wherein said member comprises a cube.

15. The speech unit as claimed in claim 14 wherein at least one of said plurality of electrodes comprises a common electrode.

16. The speech unit as claimed in claim 15 wherein said plurality of electrodes include at least three contacts disposed on orthogonal faces of said cube.

17. The speech unit as claimed in claim 16 wherein said common electrode is disposed approximately in the center of said cube.

18. The speech unit is claimed in claim 17 wherein said conducting medium comprises salt water.

19. The speech unit as claimed in claim 18 wherein said conducting medium comprises mercury.

20. The speech unit as claimed in claim 12 wherein said toy figure comprises a doll.

21. The speech unit as claimed in claim 12 wherein said toy figure comprises a ball.

22. The speech unit as claimed in claim 12 wherein said first converting means comprises a plurality of first and second flip flops, said first flip flops for storing said first signals corresponding to the present sensed orientation of said gravity sensing means, said second flip flops for storing said first signals corresponding to the prior sensed orientation of said gravity sensing means.

23. The speech unit as claimed in claim 22 wherein said first flip flops have as output immediate position signals and said second flip flops have as output delayed position signals, said immediate position signals and said delayed position signals forming said digital words.

24. The speech unit as claimed in claim 23 wherein said first converting means further includes reversing means for reversing the state of said first signals.

25. The speech unit as claimed in claim 23 wherein said plurality of electrodes include at least three contacts disposed on orthogonal faces of said cube.

26. The speech unit is claimed in claim 25 wherein said common contact is disposed approximately in the center of said cube.

27. The speech unit is claimed in claim 26 wherein said conducting medium comprises salt water.

28. The speech unit as claimed in claim 27 wherein said conducting medium comprises mercury.

29. The speech unit as claimed in claim 12 wherein said second converting means comprises a digital speech synthesizer coupled to a storage means, said storage means storing a plurality of preselected speech signals, one of said speech signals being selected for each of said digital words.

30. The speech unit as claimed in claim 29 wherein one of said speech signals is selected for every other digital word.

31. A speech unit for use with a toy figure, said speech unit comprising:

a gravity sensing means for providing a plurality of first signals having a first and second state, said first signals corresponding to the orientation of said gravity sensing means with respect to gravity;

a first converting means coupled to said gravity sensing means, said first converting means for converting said first signals into a plurality of second and third signals;

timing means coupled to said first converting means, said timing means outputting a digital word when said gravity sensing means maintains a constant orientation for at least a first period of time, said timing means reducing the power consumption of said speech unit when said gravity sensing means maintains a constant orientation for at least a second period of time;

second converting means coupled to said timing means for converting said digital word to a plurality of speech signals;

speaker means coupled to said second converting means for producing audible sounds in response to said speech signals.

32. The speech unit as claimed in claim 31 wherein said gravity sensing means comprises a hollow member partially filled with a conducting medium, said member having a plurality of electrodes disposed on the surface of said member.

33. The speech unit as claimed in claim 32 wherein said member comprises a cube.

34. The speech unit as claimed in claim 33 wherein at least one of said plurality of electrodes comprises a common contact.

35. The speech unit as claimed in claim 34 wherein said first converting means comprises a plurality of first and second flip flops, said first flip flops for storing said first signals corresponding to the present sensed orientation of said gravity sensing means, said second flip flops for storing said first signals corresponding to the prior sensed orientation of said gravity sensing means.

36. The speech unit as claimed in claim 35 wherein said first flip flops have as output immediate position signals and said second flip flops have as output delayed position signals.

37. The speech unit as claimed in claim 36 wherein said first converting means includes a reversing means for reversing the state of said first signals.

38. The speech unit as claimed in claim 37 wherein said reversing means comprises a plurality of resistors coupled to said electrodes and to the input of an exclusive OR gate, a plurality of Schmidt trigger inverter coupled to said electrodes and to a second input of said exclusive OR gates, an oscillator coupled to said common contact and to said first and second flip flops.

39. The speech unit as claimed in claim 38 wherein said timing means comprises a magnitude comparator coupled to said immediate position signals and to said delayed position signals, said comparator having a first output when said immediate position signals are equal to said delayed position signals and having a second output when said immediate position signals are not equal to said delayed position signals;

first and second multivibrators coupled to the output of said magnitude comparator, said first multivibrator producing a fifth signal when said second output of said comparator is constant for said first period of time, said second multivibrator producing a sixth signal when said second output of said comparator is constant for at least said second period of time;

a plurality of third flip flops coupled to said immediate position signals, a plurality of fourth flip flops coupled to said third flip flops, said fifth signal providing a clocking signal for said third and fourth flip flops, the outputs of said third and fourth flip flops forming said digital word.

40. The speech unit as claimed in claim 39 wherein said second converting means comprises a digital speech synthesizer coupled to a storage means, said storage means storing a plurality of preselected speech signals, said speech synthesizer outputting one of said plurality of speech signals for each of said digital words.

41. The speech unit as claimed in claim 40 wherein one of said speech signals is selected for every other of said digital words.

42. The speech unit as claimed in claim 31 wherein said toy figure comprises a doll.

43. The speech unit as claimed in claim 31 wherein said toy figure comprises a ball.

* * * * *